US008156905B2

(12) United States Patent
Stemmer

(10) Patent No.: US 8,156,905 B2
(45) Date of Patent: Apr. 17, 2012

(54) INTERNAL COMBUSTION ENGINE HAVING A CYLINDER CRANKCASE AND A V-SHAPED CYLINDER CONFIGURATION

(75) Inventor: Xaver Stemmer, Reichertshofen (DE)

(73) Assignee: Audi AG, Ingolstadt (DE)

( * ) Notice: Subject to any disclaimer, the term of this patent is extended or adjusted under 35 U.S.C. 154(b) by 422 days.

(21) Appl. No.: 12/445,618

(22) PCT Filed: Oct. 13, 2007

(86) PCT No.: PCT/EP2007/008903

§ 371 (c)(1),
(2), (4) Date: Apr. 15, 2009

(87) PCT Pub. No.: WO2008/049525

PCT Pub. Date: May 2, 2008

(65) Prior Publication Data

US 2010/0288224 A1 Nov. 18, 2010

(30) Foreign Application Priority Data

Oct. 27, 2006 (DE) ..... 10 2006 050 827

(51) Int. Cl.
*F02B 75/22* (2006.01)
*F02F 7/00* (2006.01)
*F01M 1/02* (2006.01)

(52) U.S. Cl. ..... 123/54.4; 123/195 R; 123/196 R; 123/54.5; 123/54.6; 123/54.7; 184/6.5; 184/6.13

(58) Field of Classification Search ..... 123/54.4; 184/6.5, 6.13
See application file for complete search history.

(56) References Cited

U.S. PATENT DOCUMENTS

| | | | | | |
|---|---|---|---|---|---|
| 3,045,898 | A * | 7/1962 | Hilfing et al. | 417/265 |
| 4,528,969 | A * | 7/1985 | Senga | 123/572 |
| 4,541,399 | A * | 9/1985 | Tanaka et al. | 123/573 |
| 5,533,474 | A * | 7/1996 | Hufendiek et al. | 123/196 AB |
| 5,769,036 | A * | 6/1998 | Takahashi et al. | 123/41.33 |
| 5,937,804 | A * | 8/1999 | Kaminski | 123/54.7 |
| 6,418,886 | B1 * | 7/2002 | Haimerl et al. | 123/41.28 |
| 6,769,390 | B2 * | 8/2004 | Hattori | 123/195 R |
| 2003/0024299 | A1 * | 2/2003 | Fujita et al. | 73/23.31 |

FOREIGN PATENT DOCUMENTS

| | | | |
|---|---|---|---|
| DE | 1052747 | | 3/1959 |
| DE | 19736500 | A1 | 12/1998 |
| DE | 10043795 | A1 | 3/2002 |
| EP | 1207277 | A1 | 5/2002 |
| EP | 1685889 | A1 | 8/2006 |
| GB | 688069 | | 2/1953 |
| GB | 689660 | | 4/1953 |
| JP | 62032208 | A * | 2/1987 |
| JP | 06299838 | A * | 10/1994 |
| WO | 2006000268 | A1 | 1/2006 |

* cited by examiner

*Primary Examiner* — Noah Kamen
*Assistant Examiner* — Grant Moubry
(74) *Attorney, Agent, or Firm* — Novak Druce + Quigg LLP

(57) ABSTRACT

An internal combustion engine having a cylinder crankcase and a v-shaped cylinder configuration and having a lubricant circuit which operates according to the dry sump principle and has a lubricant reservoir, wherein the lubricant reservoir is located within the cylinder crankcase in the space between the cylinders.

14 Claims, 1 Drawing Sheet

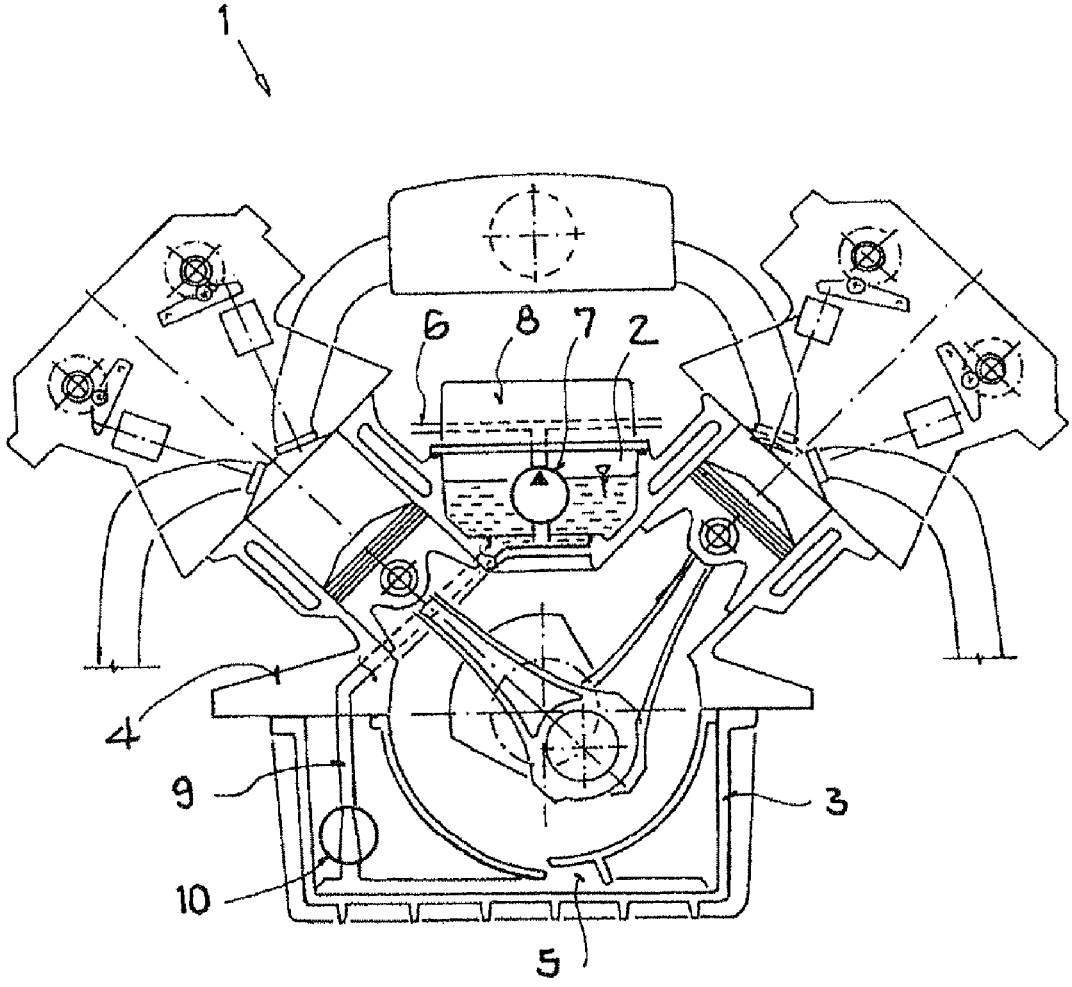
1
6
8
7
2
4
9
3
10
5

INTERNAL COMBUSTION ENGINE HAVING A CYLINDER CRANKCASE AND A V-SHAPED CYLINDER CONFIGURATION

The invention relates to an internal combustion engine with a cylinder crankcase and a v-shaped cylinder configuration.

BACKGROUND OF THE INVENTION

Internal combustion engines with a lubricant circuit according to the dry sump principle have a separate lubricant reservoir into which the lubricant is pumped out of a small reservoir underneath the crankshaft by means of a lubricant pump, and out of which the lubricant is conveyed to the lubrication sites of the internal combustion engine. Such a lubricant circuit is described, for example, in document DE 38 20 480.

One of the major advantages of dry sump lubrication consists in the lubricant reservoir which is not located underneath the crankshaft, as a result of which the internal combustion engine has a lower center of gravity and the internal combustion engine requires less installation space vertically.

But the disadvantage is that installation space for the configuration and the tubing of the separate lubricant reservoir must be provided in the engine compartment of the motor vehicle.

The object of the invention is to devise an internal combustion engine with a lubricant circuit using the dry sump principle in which the lubricant reservoir requires little installation space and thus can be produced very economically.

SUMMARY OF THE INVENTION

This object is achieved by means of which the lubricant reservoir is located within the cylinder crankcase in the installation space between the cylinders or the rows of cylinders of the internal combustion engine, in the so-called internal V or so-called v-space.

Here the walls of the lubricant reservoir are formed entirely by the cylinder crankcase and arise directly when the cylinder crankcase is cast.

In one advantageous development of the invention it is provided that the lubricant circuit has at least one lubricant pump which is located within the lubricant reservoir.

In this case at least parts of the housing of the lubricant pump are likewise formed by the wall of the lubricant reservoir and like the lubricant reservoir are produced directly when the cylinder crankcase is cast.

In the region of the crankshaft, as is conventional, there is a dry sump return pump which is connected to the lubricant reservoir by way of at least one connecting channel. The dry sump return pump conveys lubricant out of a small collecting space underneath the crankshaft by way of the connecting channel into the lubricant reservoir located between the rows of cylinders.

At least one connecting channel can be advantageously made on the wall of the cylinder crankcase and is likewise formed when the cylinder crankcase is cast.

In one advantageous development of the invention it is provided that the top side of the lubricant reservoir has a removable cover. The removable cover is preferably screwed to the cylinder crankcase.

In the next advantageous development of the invention it is provided that the removable cover is made as a component support.

Moreover, the removable cover is made for maintenance of the lubricant pump.

In a last advantageous development of the invention, it is provided that the lubricant circuit has a lubricant filter and that the lubricant filter is connected to the removable cover.

The lubricant reservoir located within the cylinder crankcase in the installation space between the cylinders in the engine compartment of the motor vehicle requires only a slightly larger installation space which even leaves the outside dimensions of the internal combustion engine largely unaffected. Tubing of the lubricant reservoir outside the internal combustion engine is eliminated. Moreover, the additional costs in the casting of the cylinder crankcase are minimal and replace the costs for the separate lubricant reservoir completely. Other advantages relative to installation space and costs arise due to the integration of the lubricant pump housing into the cylinder crankcase.

The internal combustion engine according to the invention with a lubricant reservoir located within the cylinder crankcase in the installation space between the cylinders is described and explained below using one embodiment in conjunction with the FIGURE.

BRIEF DESCRIPTION OF THE DRAWING

The FIGURE shows a schematic of the internal combustion engine with the lubricant reservoir located in the v-space.

DETAILED DESCRIPTION OF THE PREFERRED EMBODIMENT OF THE INVENTION

A v-shaped internal combustion engine that uses oil as the lubricant has a dry sump pressurized oil circuit whose oil reservoir is located between the two rows of cylinders, the oil reservoir being formed in one piece with the cylinder crankcase when the cylinder crankcase is cast.

The FIGURE shows a cross section through such an internal combustion engine 1. The pressurized oil circuit 6 which is only shown symbolically is driven by an external toothed gear oil pump 7 which is located within the oil reservoir 2 and which supplies all important lubrication sites of the internal combustion engine 1.

The oil reservoir 2 is filled by way of the dry sump return pump 10 which is located on the bottom of the crankshaft housing 3 for a small collecting space 5 which accommodates the oil which is flowing back from the lubrication sites. The connection between the dry sump return pump 10 and the external toothed gear oil pump 7 is formed by an oil line 9 which is preferably formed when the cylinder crankcase 4 and the crankshaft housing 3 are cast and which, however, can also be made as a separate component.

The oil reservoir 2 is covered by a cover 8 which can be removed by means of screws and by way of which the external toothed gear oil pump 7 located in the interior of the oil reservoir 2 can be maintained. Here it is provided that parts of the housing of the external toothed gear oil pump 7 or at least receivers for the external toothed gear oil pump 7 are formed when the cylinder crankcase 4 is cast.

The removable cover 8 is made as a support for other components of the internal combustion engine. Thus, a receiver for an oil filter is configured on the removable cover 8.

The described cylinder crankcase with the oil reservoir located between the cylinders requires little installation space and engenders hardly any higher costs when the cylinder crankcase is cast. Tubing of the oil reservoir outside the internal combustion engine is eliminated.

The invention claimed is:

1. An internal combustion engine having a cylinder crankcase and a v-shaped cylinder configuration and having a lubricant circuit which operates according to the dry sump principle and which has a lubricant reservoir wherein the lubricant reservoir is located within the cylinder crankcase in the installation space between the cylinders, and the lubricant circuit has at least one lubricant pump and that at least one lubricant pump is located within the lubricant reservoir.

2. The internal combustion engine according to claim 1 wherein the walls of the lubricant reservoir are formed essentially by the cylinder crankcase and that the walls of the lubricant reservoir are formed when the cylinder crankcase is cast.

3. The internal combustion engine according to claim 1 wherein at least parts of the housing of the lubricant pump are formed by the wall of the lubricant reservoir and that the parts of the housing of the lubricant pump are formed when the cylinder crankcase is cast.

4. The internal combustion engine according to claim 1 wherein in the region of the crankshaft there is a dry sump return pump and that at least one connecting channel is made between the dry sump return pump and the lubricant reservoir.

5. The internal combustion engine according to claim 4 wherein at least one connecting channel is made on the wall of the cylinder crankcase and that at least one connecting channel is formed when the cylinder crankcase is cast.

6. The internal combustion engine according to claim 1 wherein the top side of the lubricant reservoir has a removable cover and that the removable cover is screwed to the cylinder crankcase.

7. The internal combustion engine according to claim 6 wherein the removable cover is made as a component support.

8. The internal combustion engine according to claim 6 wherein the removable cover is made for maintenance of the lubricant pump.

9. The internal combustion engine according to claim 6 wherein the lubricant circuit has a lubricant filter and the lubricant filter is connected to the removable cover.

10. A cylinder block for a v-shaped internal combustion engine comprising a block having a plurality of cylinder compartments each extending from an upper portion thereof to a lower portion thereof adapted to receive a crankshaft and closure means to provide a lower lubricant compartment, a recess in an upper portion thereof, between said cylinder compartments, adapted to be closed by a closure means to provide an upper lubricant compartment, a lubricant pump disposed in said upper lubricant compartment and a lubricant passageway intercommunicating said recess and said lower portion thereof communicating with said cylinder compartments.

11. A cylinder block according to claim 10 wherein said block is cast.

12. A cylinder block according to claim 10 including at least one lubricating passageway intercommunicable between said recess and a selected site of said block.

13. A cylinder block according to claim 12 wherein said block is cast.

14. A cylinder block according to claim 10 including a lubricant pump disposed in said lower lubricant compartment interconnecting said lower lubricant compartment and said lubricant passageway.

* * * * *